United States Patent [19]

Fabian et al.

[11] Patent Number: 4,971,331

[45] Date of Patent: Nov. 20, 1990

[54] GAME DEVICE

[76] Inventors: Ellis Fabian; Karen L. Fabian, both of 49 Goddard Street, Downsview, Ontario M3H 5C9, Canada

[21] Appl. No.: 309,192

[22] Filed: Feb. 13, 1989

[51] Int. Cl.[5] ..... A63F 3/00

[52] U.S. Cl. ..... 273/238; 273/271; 273/284; 273/282

[58] Field of Search ..... 273/238, 271, 280, 282 R, 273/284, 281

[56] References Cited

U.S. PATENT DOCUMENTS

| | | | |
|---|---|---|---|
| 818,237 | 4/1906 | Elburn . | |
| 1,499,214 | 6/1924 | Grigbel . | |
| 2,751,228 | 6/1956 | Rojo . | |
| 3,030,112 | 4/1962 | Scharp | 273/280 |
| 3,195,896 | 7/1965 | Markham | 273/280 |
| 3,427,029 | 2/1969 | Riva . | |
| 3,537,708 | 11/1970 | Carr | 273/238 |
| 3,588,113 | 4/1969 | Nelson | 273/282 R |
| 3,588,113 | 6/1971 | Nelson . | |
| 3,843,131 | 10/1974 | Stubbmann | 273/280 |
| 3,995,862 | 12/1976 | Bertin . | |
| 4,149,727 | 4/1979 | Penney . | |
| 4,234,185 | 11/1980 | Alsip | 273/271 |
| 4,452,455 | 6/1984 | Bergstrom et al. | 273/280 |

FOREIGN PATENT DOCUMENTS

| | | | |
|---|---|---|---|
| 3204010 | 8/1983 | Fed. Rep. of Germany | 273/280 |
| 2185894 | 8/1987 | United Kingdom | 273/280 |

OTHER PUBLICATIONS

TAC-TIC TURN, Irwin Toy Limited, Toronto, Ontario, Canada (bears a copyright notice dated 1987).

*Primary Examiner*—Edward M. Coven
*Assistant Examiner*—Dean Small
*Attorney, Agent, or Firm*—Wegner & Bretschneider

[57] ABSTRACT

A strategy game device having a support base with a top surface and at least three peg receptacles, each rotatably connected to the base at the center of the receptacle. Each receptacle has at least three peg-receiving holes equally spaced about the periphery of the receptacle. The number of holes in each receptacle is the same. There are at least two sets of pegs and each set comprises a number of pegs which can be inserted in the aforementioned holes. Each set has a color different than the color of the other sets. In one version the centers of the peg receptacles are spaced apart along a straight line extending parallel to the top surface of the base. In another version the peg receptacles are circular and are rotatable about a common center axis. In the preferred version of this embodiment, each receptacle has eight peg-receiving holes equally spaced from one another about the periphery.

13 Claims, 6 Drawing Sheets

GAME DEVICE

BACKGROUND OF THE INVENTION

This invention relates to an apparatus for playing a strategy game, and in particular a game involving the alignment of pegs or other indicia in a straight line pattern or other optional, pre-specified pattern.

A wide variety of competitive games and gaming devices requiring strategy or mental skill are known and are used for entertainment or intellectual stimulation. One well known strategy game is chess, which game requires a number of different and distinct playing pieces for each player and there are different rules for the movement of each type of playing piece. Another strategy game wherein the playing pieces, at least initially, for each player are identical is checkers which is played normally with flat circular disks on a playing surface having rows of squares of alternating colors. A very simple strategy game that can be played with pencil and paper is known as x's and o's or tic-tac-toe. This game can be uninteresting as in many cases there is no winner. Also the player who has the first move has a significant advantage.

A more recent strategy game is one being manufactured and sold under license from Ned Strongin Creative Services and is a game known as Tac-Tic-Turn. This game has a square playing surface which is filled with nine square tiles arranged in three rows. Each tile has four recesses formed in its top to receive a possible four checkers. The object of the game is to be the first player to get a certain number of coloured checkers in a row vertically, horizontally or diagonally. Players take turns placing the colored checkers on the board. Each player has the option on his turn of placing another checker on the board or turning a tile 90 degrees.

U.S. Pat. No. 3,588,113 issued June 28, 1971 to John Nelson describes a strategy game that employs a board with three concentric, rotatable rings mounted in the top of the board. Each ring can be locked in any one of four equally angularly spaced positions. Four indentical "tic-tac-toe" patterns made up of nine peg holes each are formed by the alignment of the rings. Pegs or markers are placed in the holes and the resulting patterns can be changed by rotation of the rings.

The game devices of the present invention can be quite simple in their structure but they can provide a very challenging and competitive game of strategy.

It is an object of the present invention to provide a game apparatus involving the alignment of three or more indicia, markers or pegs in a straight line or other optional, pre-specified pattern, which apparatus can require considerable skill to play well.

It is a further object of the present invention to provide a novel game apparatus which in one form employs at least three circular peg receptacles rotatably mounted on a support base, each receptacle having peg-receiving holes equally spaced from adjacent holes about the periphery of the receptacle.

SUMMARY OF THE INVENTION

According to one aspect of the present invention, a game apparatus comprises a support base having a top surface and at least three peg receptacles, each rotatably connected to the base at the center of the receptacle. Each receptacle has at least three peg-receiving holes equally spaced about the periphery of the receptacle and the number of holes in each receptacle is the same.

At least two sets each comprising a number of pegs are adapted to be received in the holes. Each set has a color different than the color or colors of the other set or sets. The center of the peg receptacles are spaced apart along a line extending parallel to the top surface of the base.

According to another aspect of the present invention a game apparatus comprises a support base and at least three circular peg receptacles mounted on the base and rotatable thereon about a common center axis. Each receptacle has five or more peg-receiving holes equally spaced about the complete periphery of the receptacle. The number of holes in each receptacle is the same so as to permit straight line radial alignment of the holes in the receptacles. At least two sets of pegs are adapted to be received in the holes with each set having a color different than the color or colors of the other set or sets.

Preferably in this version there are seven peg receptacles mounted on the base and rotatable thereon about a common center axis.

According to still another aspect of the invention, a game apparatus comprises a support base and at least four, straight parallel rows of peg receptacles each rotatably connected to the base at the center of the receptacle. Each row has at least four peg receptacles therein and each peg receptacle has at least four peg-receiving holes equally spaced about the periphery of the receptacle. The number of holes in each receptacle is the same. At least two sets of pegs are adapted to be received in the holes. Each set having a color different than the color or colors of the other set or sets.

In a preferred version of this game apparatus, the peg receptacles are circular disks of the same size and the peg-receiving holes in each receptacle are equally spaced from the center of the disk.

Further features and advantages will become apparent from the following detailed description taken in conjunction with the accompanying drawings.

DETAILED DESCRIPTION OF PREFERRED EMBODIMENTS

Figure 1:
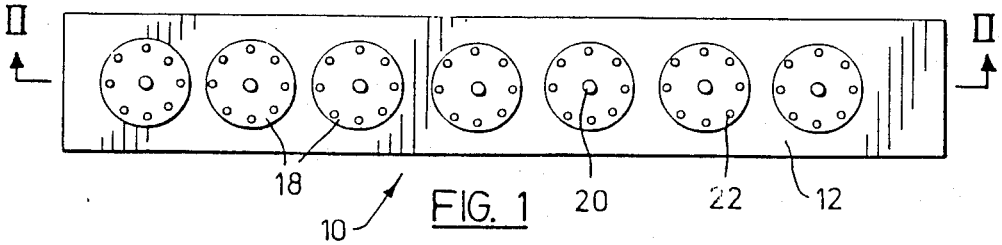
FIG. 1 is a plan view of a first embodiment of a game apparatus constructed in accordance with the invention.
Figure 2:
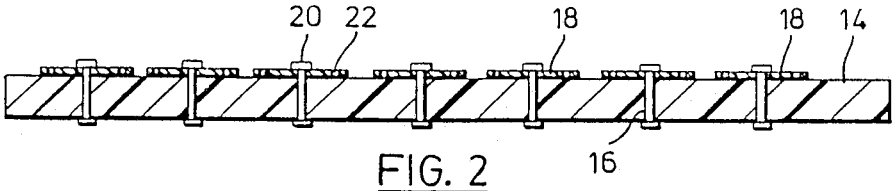
FIG. 2 is a cross-sectional elevation taken along the line II—II of FIG. 1.
Figure 3:
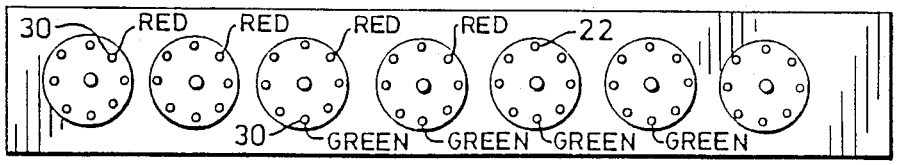
FIG. 3 is a plan view of a game apparatus of FIG. 1 but showing winning combinations of pegs inserted into some of the circular discs.

With reference to FIGS. 1 to 3 of the drawings, a first version of the invention comprises a game apparatus or device 10 having a support base or base plate 12 which can be of rectangular configuration. This base plate has a flat top surface 14 with a number of holes 16 formed therein. A number of peg receptacles 18 are each rotatably connected to the base at the center of the receptacle. There are at least three of these peg receptacles arranged in a line and in the preferred illustrated embodiment there are seven such receptacles arranged in a straight line. The preferred receptacle in this version is a circular disk and all such disks are of the same size. Each receptacle can be attached to the support base by a rivet 20. The rivet which forms a pivot pin passes through the aforementioned hole 16.

Figure 4:
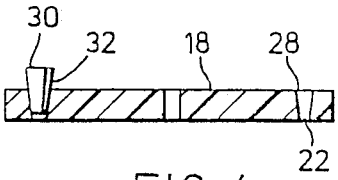
FIG. 4 is an axial cross-section of one of the circular disks used in the game apparatus of FIGS. 1 and 2.

Each peg receptacle has at least three peg-receiving holes 22 equally spaced about the periphery of the receptacle. The number of such holes in each receptacle is the same. In the preferred illustrated embodiment there are eight peg-receiving holes 22 equally spaced about the periphery. These holes are equidistant from the center of the disk and the rivet 20. As illustrated in FIG. 4 the peg-receiving holes 22 are preferably tapered so that the diameter of each hole decreases from the top 28 of the hole to the bottom thereof. Also as shown in FIG. 4, each peg 30 forming part of the game apparatus is preferably tapered from top to bottom. The preferred peg 30 is dimensioned so that when it is seated in any of the holes 22, an upper portion 32 protrudes above the top of the peg receptacle 18 and no portion of the peg protrudes below the circular peg receptacle. Thus the peg will not interfer with manual rotation of the peg receptacle.

The support base 12, peg receptacles 18 and pegs 30 can be made of a plastics material such as polypropylene. The rivets 20 can also be made of a plastics material such as polypropylene or made of a metal such as steel.

There are at least two sets of pegs provided with the game apparatus so that at least two players can play. If more than two sets are provided, it is possible for the game to be played by more than two players. Preferably each set has a number of pegs of the same color and configuration equal to one-half the total number of peg-receiving holes in all the receptacles and the color of each set is different from the color or colors of the other set or sets in order that the pegs inserted by each player can be distinguished. Thus in the preferred version of FIG. 1, each set has at least twenty-eight pegs.

Figure 6:
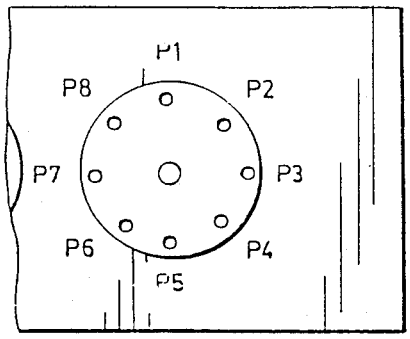
FIG. 6 is a detailed plan view of one end of the game apparatus of FIG. 1 showing optional labelling for the eight peg-receiving holes.

For the start of the game, all of the peg receptacles or disks 18 are oriented in the same or identical manner such as in the manner shown in FIG. 1. Thus each and every hole of each disk is located on an imaginary straight line that also passes through a corresponding hole in each of the other disks or peg receptacles. To help confirm or establish a winning peg alignment, the various hole positions can be labelled in the manner shown in FIG. 6. In this embodiment, the hole positions are labelled on the support base as P1 through to P8.

At the beginning of the game the players must establish what particular peg configuration is to be the winning combination. Two possible winning combinations, one red and one green, are illustrated in FIG. 3 of the drawings wherein there are four red pegs arranged in a straight line and also four green pegs arranged in a straight line. Thus the object of the game can be to arrange four pegs of the same color on any four neighboring disks with the four pegs in holes of identical label i.e. P2 in the case of the red pegs of FIG. 3 and P5 in the case of the green pegs.

In addition to selecting the objective for winning the game, it is also necessary for the players to select the set of rules by which the game is to be played. One possible set of rules for such a game is as follows:

(1) The game will be played on the basis of skill alone (that is there will be no element of chance involved);

(2) The players will take consecutive turns during the course of a game;

(3) The competing players can play in any selected order but once the order is determined they must continue to play in that order;

(4) During each turn the player must first place one of his pegs into any unoccupied peg-receiving hole of his choosing in any disk and, secondly, he must rotate any disk of his choosing, except the disk into which he placed the peg, a certain number of positions clockwise or a certain number of positions counterclockwise (for example with the peg receptacles shown in FIG. 1 the option could be a clockwise rotation of one hundred and thirty-five degrees equivalent to a rotation of three positions or a counterclockwise rotation of forty-five degrees equivalent to one position); and (5) The winner is a player who first attains the stated objective being a specified peg configuration.

Figure 5:
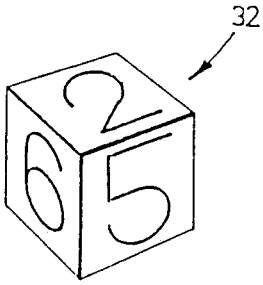
FIG. 5 is a perspective view of a single die that can be used with the game apparatus.

Another possible set of rules for playing a game of this type is as follows:

(1) The game will be based on a combination of skill and chance;

(2) The players will each take a turn in consecutive order with the order of play being determined at the beginning of the game and remaining fixed thereafter;

(3) During a player's turn, the player must first roll a standard six sided die such as the die 32 shown in FIG. 5. The die 32 has its sides numbered one to six respectively. Next the player must insert one of his pegs into any unoccupied peg-receiving hole 22 of his choosing and then rotate the disk into which this peg has been inserted as many units of forty-five degrees, that is positions, as the number rolled by means of the die 32. Whether he rotates his disk clockwise or counterclockwise is decided by the immediately following player.

(4) The winner is the player who attains the prespecified peg configuration last.

A further rule that can be added to either of the above mentioned sets of rules (at the option of the players) is that during each turn, if a competitor's peg ends up in position P1 for the rotated disk, the player must remove the competitor's peg from the hole at the P1 position.

Figure 7:
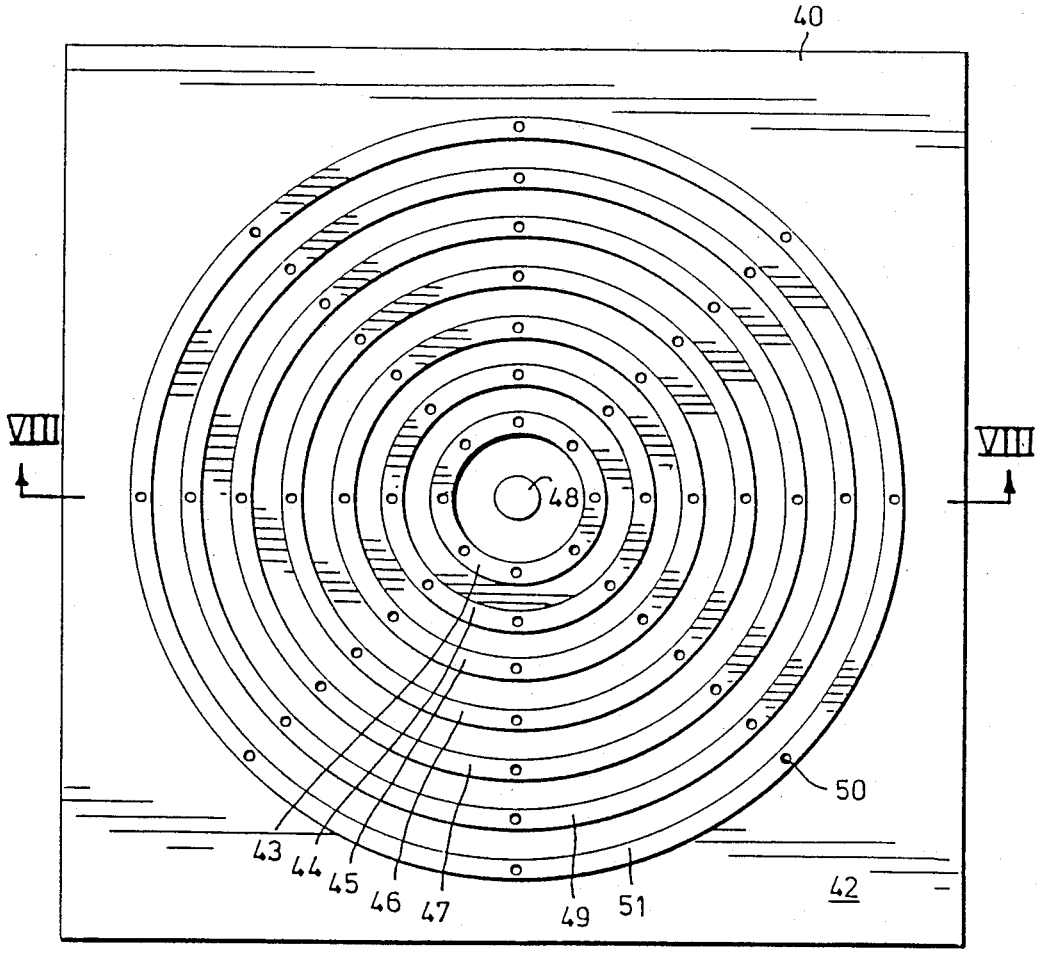
FIG. 7 is a plan view of another embodiment of a game apparatus constructed in accordance with the invention.
Figure 8:
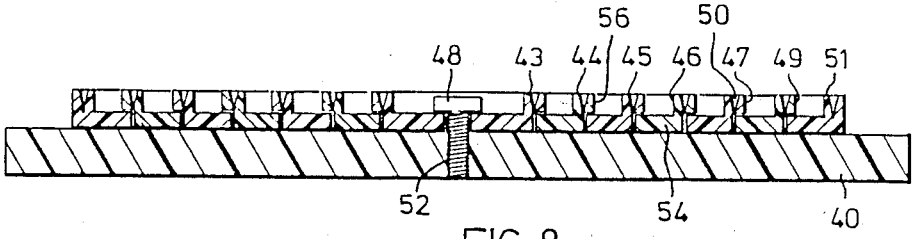
FIG. 8 is a sectional elevation taken along the line VIII—VIII of FIG. 7.

Turning now to a second embodiment of the invention illustrated in FIGS. 7 and 8 of the drawings, this embodiment has a support base 40 which as illustrated can be square and can comprise a flat plate with an upper surface 42. There are at least three circular peg receptacles mounted on this base 40 and rotatable thereon about a common center axis. In the illustrated version there are in fact seven peg receptacles 43 to 47, 59, 51 connected to the support base by a suitable pivot pin member 48. Each receptacle has in this version five or more peg-receiving holes 50 equally spaced from adjacent holes about the periphery of the annular receptacle. The number of holes 50 in each receptacle is the same, thereby permitting straight line radial alignment of the holes in the receptacles. In the illustrated version of the game there are eight peg-receiving holes 50 in each receptacle.

The innermost receptacle 43 is rotatably connected to the support base by a pin member 48 which can be a round headed bolt held by threads 52 in a hole formed in the center of the plastic base. Each receptacle has a flat lower section 54. In the case of the six outer receptacles 44 to 47, 49, 51 this lower section fits under an upper section 56 of the adjacent receptacle located radially inwardly therefrom. The lower section 54 of the innermost receptacle 43 fits under the head of the pin member 48. In this way the seven receptacles are rotatably connected to the support base and cannot fall away therefrom if the device is tipped or upset.

Figure 9:
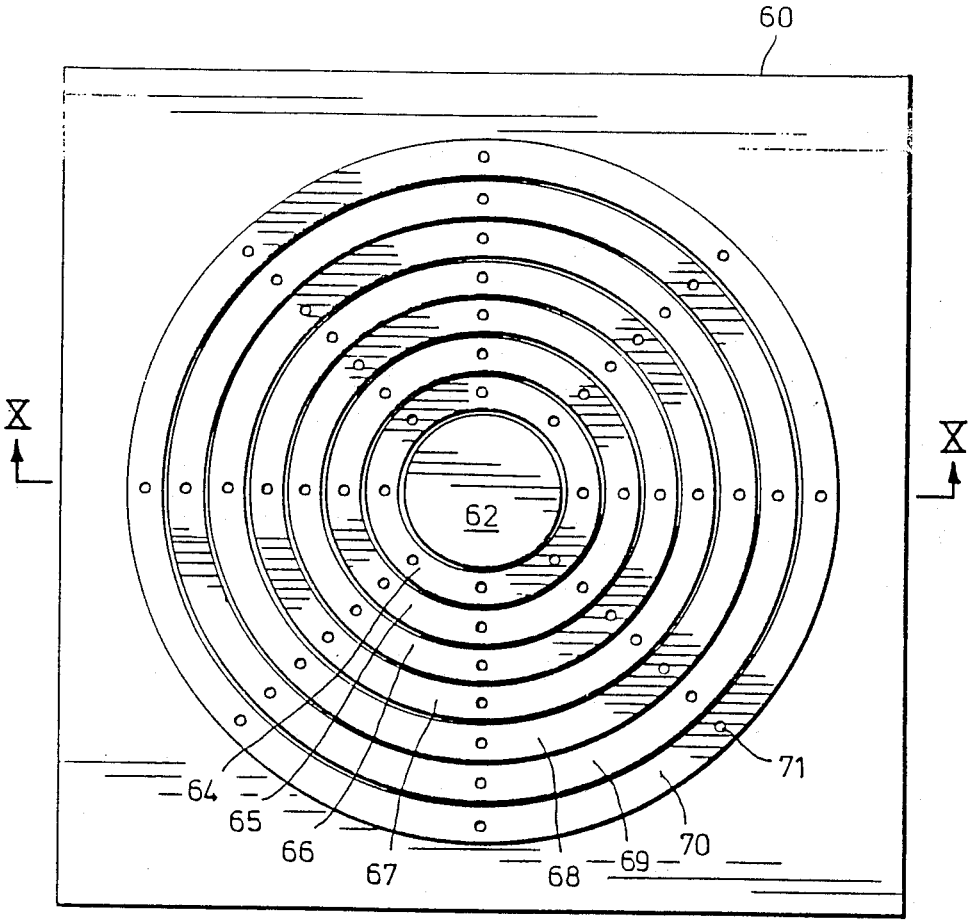
FIG. 9 is a plan view of a further embodiment of the invention.
Figure 10:
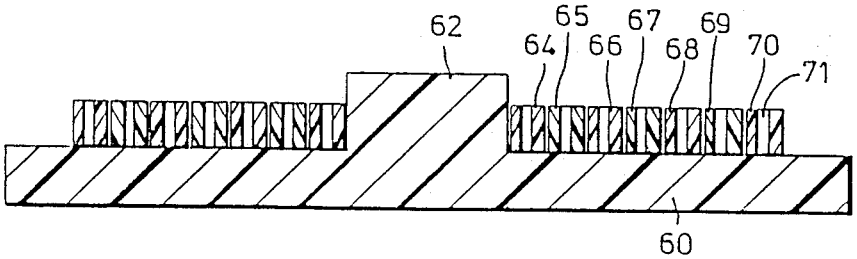
FIG. 10 is a cross-sectional elevation taken along the line X—X of FIG. 9.

Turning now to FIGS. 9 and 10 of the drawings which illustrate a third embodiment similar to the embodiment of FIGS. 7 and 8, there is again a square support base 60 upon which is mounted a number of circular peg receptacles which are free to rotate about a cylindrical protrusion 62 formed on the support base. Although there can be as few as three of these peg receptacles, the illustrated version has seven annular receptacles 64 to 70 of different radii. These receptacles are simply concentric rings with flat bottom and top sides. The smallest peg receptacle or ring 64 has an inside diameter that is only slightly larger than the diameter of the protrusion 62 about which it rotates. Each larger peg receptacle is rotatable about the outer circumferential surface of the adjacent, smaller peg receptacle. Each receptacle 64 to 70 has eight peg-receiving holes 71 equally spaced from adjacent holes about the periphery of the ring. This version of FIGS. 9 and 10 is played with sets of pegs in the same manner as the version of FIGS. 7 and 8. Preferably there are a number of pegs of the same configuration in each set equal to one-half the total number of peg-receiving holes. Thus for the illustrated game device having seven rings, there are preferably at least 28 pegs in each set. The game apparatus of FIGS. 7 to 10 can be played with a standard die in the same manner as the first embodiment in order to introduce an element of chance.

Figure 11:
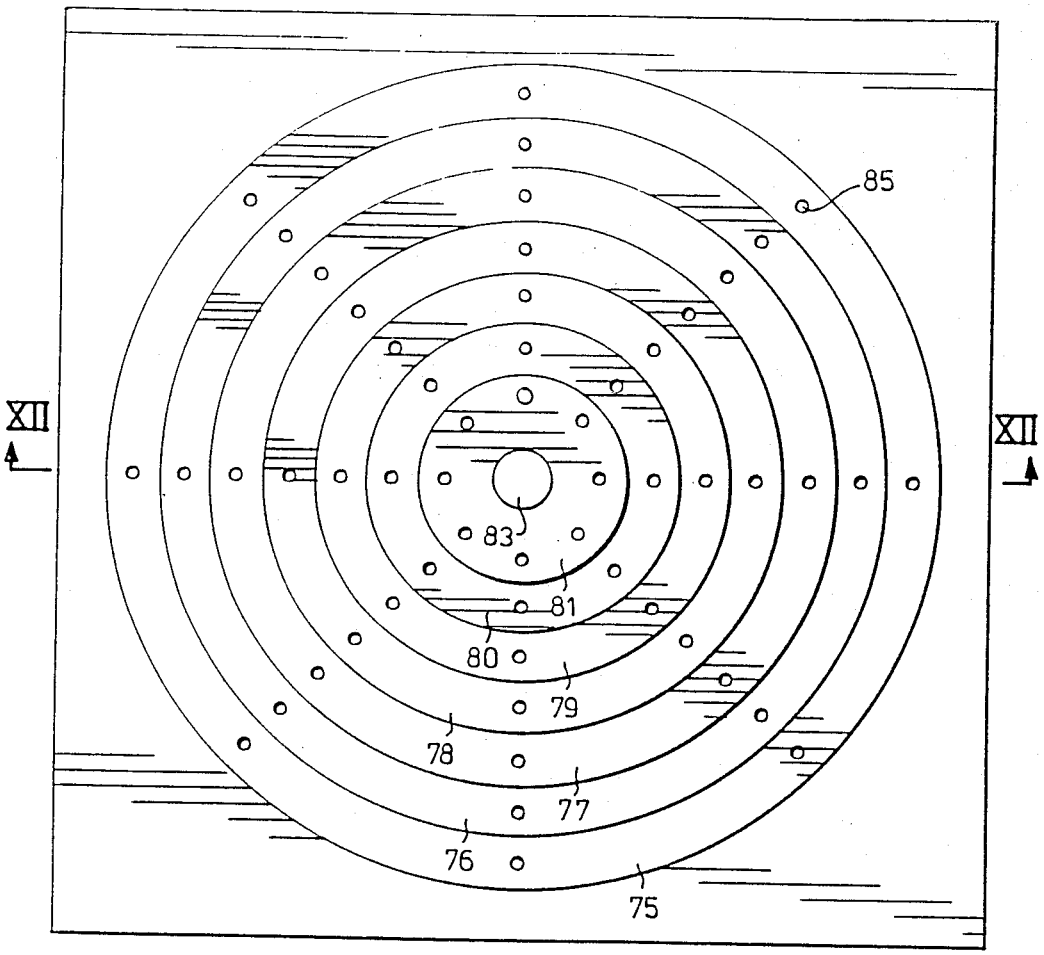
FIG. 11 is a plan view of a still further embodiment of the invention employing a stack of circular discs of different radii.
Figure 12:
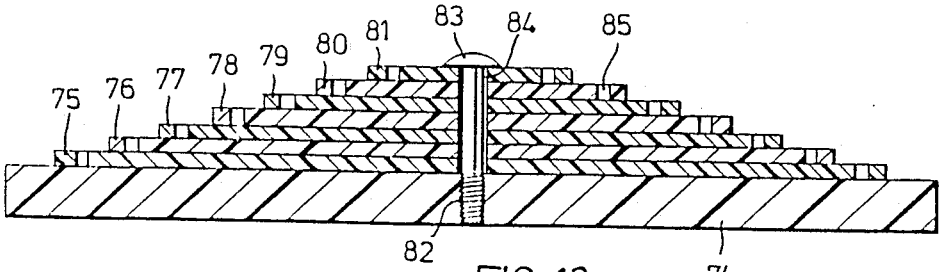
FIG. 12 is a cross-sectional elevation taken along the line XII—XII of FIG. 11.

The fourth embodiment of FIGS. 11 and 12 can be made with a rectangular or square base 74 Rotatably mounted on this support base are circular peg receptacles in the form of circular disks of different radii. Again although there can be as few as three disks, the illustrated embodiment has seven disks 75 to 81. All of the peg receptacles or disks are connected to the base by single pivot pin member 83 which can take the form of a round headed bolt. The pin member 83 can have threads 82 to engage in a threaded hole formed in the base 74.

Again each of the peg receptacles 75 to 81 has peg-receiving holes 85 equally spaced from adjacent holes about the periphery of the receptacle. Each of the circular disks has a center hole 84 through which the pin member 83 extends. This center hole is only slightly larger than the diameter of the pin member in order that the disks are kept in proper vertical alignment. At the beginning of the game and throughout the game the peg receiving holes are arranged to form radially extending straight lines as shown in FIG. 11. When any disk is rotated clockwise or counterclockwise it must be rotated in a multiple of forty-five degrees in order to keep the holes aligned in the illustrated manner.

Figure 13:
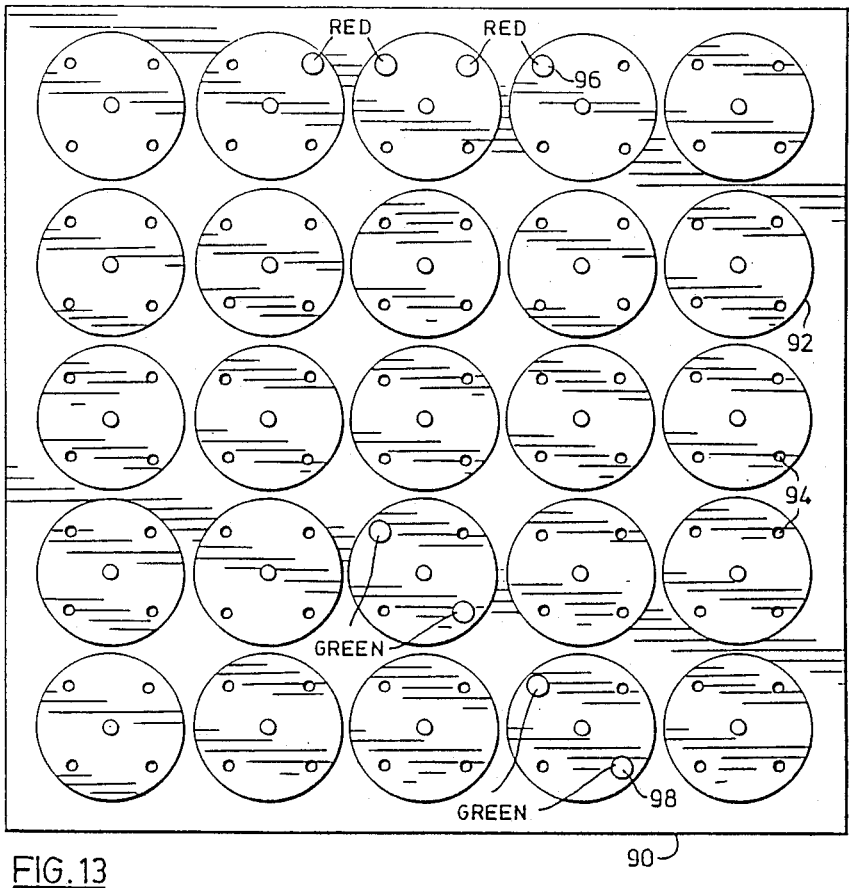
FIG. 13 is a plan view of still another embodiment of the invention employing twenty-five identical round discs arranged in five rows.

Turning now to the further embodiment of the invention illustrated in FIG. 13, there is a generally square support base 90 which can be in the form of a flat plastic plate. There are rows of peg receptacles 92 each rotatably connected to the base 90 at the center of the receptac1e. In the preferred illustrated embodiment, there are five, straight parallel rows of such receptacles but it will be understood that there could be as few as four rows or more than five rows of receptacles if desired. In the illustrated embodiment there are five peg receptacles 92 in each row, but it will be understood that there could be four or more receptacles in each row if desired. Each of these peg receptacles has four peg-receiving holes 94 equally spaced about the periphery of the receptacle or disk. The number of holes 94 in each receptacle is the same. There can be more than four holes in each receptacle if desired. For example the disks of this version can have the same number of holes (eight) as the disks of the embodiment of FIG. 1. Except for the number of holes in the disk of the version of FIG. 13, the disks are constructed in the same manner and attached to the board in the same manner as the disks illustrated in FIGS. 1 to 4. The totality of receptacles are positioned so that the centers of all receptacles form a regular or orthogonal grid with identical center-to-center distance vertically and horizontally between any two immediately neighbouring receptacles.

In playing a strategy game with the game board of FIG. 13, the players again select an objective to be achieved in order to win the game. For example the players could decide that the first player who is able to arrange four of his pegs in any four neighboring holes 94 on any straight line will win. Two of such winning combinations are illustrated in FIG. 13. The red pegs 96 are arranged in a horizontal line across the top of the game device while the four green pegs 98 are arranged along a diagonal straight line. Of course not only could a winning combination consist of the illustrated straight lines but a vertical straight line would also be quite satisfactory. In general it is to be understood that target winning combinations need not be restricted to patterns lying on a straight line.

With the four holed disks of FIG. 13, the four holes in each disk should be oriented at the beginning of the game and throughout the game in the illustrated manner. That is the four holes on each disk form an imaginary square whose sides extend horizontally and vertically or parallel to the sides of the square support base 90. In turning any of the disks of the FIG. 13 version, the disk would be turned in a multiple of ninety degrees either clockwise or counterclockwise. With the version of FIG. 13, preferably more than 28 pegs would be provided for each color. An ideal number would be fifty of each color which would provide sufficient pegs in two different colors to fill all of the holes of the twenty-five disks.

Figure 14:
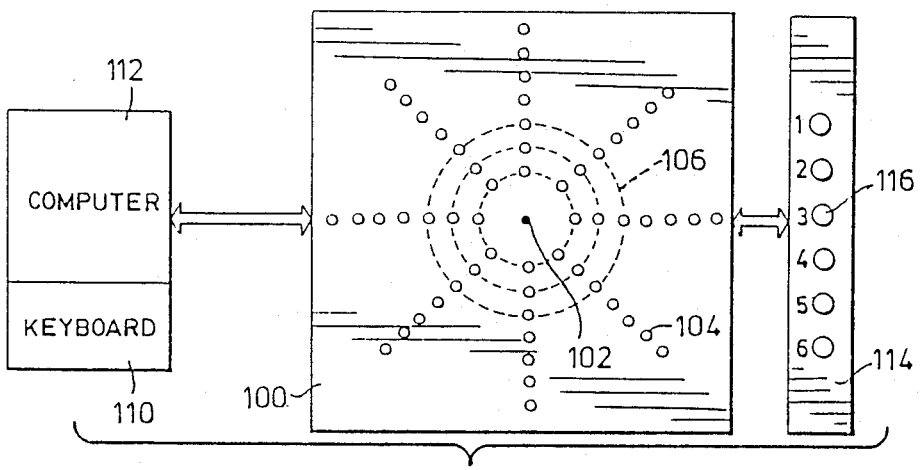
FIG. 14 is a schematic illustration of a further embodiment of the invention which employs a computer and a game board having rows of light bulbs.

A final illustrated embodiment of the invention shown in FIG. 14 has a support base 100 which can be square as shown and which has a central location thereon indicated at 102. Means are provided for forming five or more radial lines of indicia extending out from the central location. In the illustrated preferred version there are eight such radial lines. Each of the five or more lines is made up of at least three spaced apart spots 104 for individual indicia. These spots form concentric circular patterns about the central location, one of which is indicated by the dashed line 106. The number of spots in each of these circular patterns is the same. In the illustrated version of FIG. 14 there are eight such spots 104 in each circular pattern. In the illustrated embodiment there are seven such concentric circular patterns extending around the central location 102.

In the preferred embodiment of FIG. 14 each spot on the display board 100 is represented by a light emitting means in the form of a light bulb of known construction. Instead of light bulbs, light fiber bundles or light-emitting diodes of known construction can also be used. These light bulbs or other light emitting means can be lit up as desired from a standard computer keyboard 110 through which players can input signals into a computer 112. Again the computer itself can be of standard construction providing it is capable of operating the necessary switches to operate all of the lights on the display board 100.

Not only is the computer 112 able to turn any of the lights on or off as instructed but it is programmed with the necessary software to permit instructions to be sent through the keyboard to rotate the light pattern in any of the circular patterns 106 clockwise or counterclockwise a multiple of forty-five degrees. Each lightbulb, light fiber bundle, or other light-emitting means is capable of emitting at least two distinct colors and preferably four distinct colors (so as to permit up to four players in a game). If desired one of the players in the game can be the computer itself.

With the computer embodiment of FIG. 14, a random number generator other than a standard die can be used if desired. The computer 112 can be programmed to generate on a random basis a number from one to six. The generated number can then be displayed on a video screen of the computer, if it has such a screen, or the number could be indicated on a special number indicator 114 having six special bulbs 116 mounted thereon. Of course the number indicator 114 can be an integral part of the display board 100 if desired. The lightbulbs 116 or other light-emitting means such as light-emitting diodes would not have to generate more than one color since each bulb would only have to be either on or off.

Also with the computer based version of FIG. 14, the objective of the game could be entered into the computer through the keyboard and this will enable the computer to indicate to the players when a particular player has won the game. Furthermore the computer can generate through suitable software a menu of game rules that the players can select prior to commencement of the game and then the computer would ensure that these rules are followed during the course of the game.

Various modifications and changes to the described embodiments of the invention will be apparent to those skilled in this art. Accordingly all such modifications and changes as fall within the scope of the appended claims are intended to be part of this invention.

For example instead of circular peg receiving receptacles, these receptacles can be symetrical multi-pointed stars, symetrical multi-armed crosses or other suitable shapes. Also one can readily provide means for securing the receptacles at equally spaced angular intervals. For example, a spring loaded pointer engaging an indentation on the periphery of the receptacle or a spring loaded ball such as commonly used on a multi-turret machine toolpost can be used for this purpose.

We therefore claim:

1. Game apparatus comprising:

a support base, at least three circular peg receptacles mounted on said base and rotatable thereon about a common center axis, each receptacle having five or more peg-receiving holes equally spaced about the complete circumference of the receptacle, the number of holes in each receptacle being the same so as to permit straight line radial alignment of the holes in the receptacles, at least two sets of pegs each comprising a number of pegs adapted to be received in said holes, each set having a color different from the color or colors of the other set or sets, wherein the number of sets of pegs used during play corresponds to the number of players or the number of teams of players, and whereby during play employing said game apparatus, the receptacles are only to be rotated by a player such that after rotation, the holes are again in radial straight line alignment, and play is to be terminated based upon a predetermined radial straight line alignment of pegs from one of said sets of pegs.

2. Game apparatus according to claim 1 wherein there are seven peg receptacles mounted on said base and rotatable thereon about a common center axis.

3. Game apparatus according to claim 2 wherein each set of pegs comprises a number of pegs of the same configuration equal to one-half the total number of peg-receiving holes in all said receptacles.

4. Game apparatus according to claim 1, wherein, the peg receptacles are rings of different radii which interengage one another in order to hold the receptacles on said base and an innermost peg receptacle is rotatably connected to said support base by a pivot pin member located at said center axis.

5. Game apparatus according to claim 1, wherein the peg receptacles are rings of different radii that are concentric to one another, the smallest peg receptacle is rotatable about a cylindrical protrusion formed on said support base, and each larger peg receptacle is rotatable about the outer circumferential surface of an adjacent, smaller peg receptacle.

6. Game apparatus according to claim 1, wherein the peg receptacles are circular disks of different radii disposed one on top of another and all of said receptacles are connected to said support base by a single pivot pin member.

7. Game apparatus according to claim 3 including a standard die having six sides numbered one to six respectively.

8. Game apparatus comprising:

a support base having a central location, means for providing five or more straight radial lines of indicia extending out from said central location, each line made up of at least three, spaced apart spots for individual indicia, said spots forming concentric circular patterns about said central location with the number of spots in each circular pattern being the same, and means for providing any of at least two indicia of different colors at each of said spots, wherein the number of colors of indicia used during play corresponds to the number of players or the number of teams of players, and wherein each circular pattern of indicia can be rotated relative to the other circular patterns about said central location, whereby during play employing said game apparatus, the circular patterns of indicia are only to rotated by a player such that after rotation, the indicia are again in radial straight line alignment, and play is to be terminated based upon a predetermined radial straight line alignment of indicia of one color.

9. Game apparatus according to claim 8 wherein there are at least five, spaced-apart spots for individual indicia in each radial line.

10. Game apparatus according to claim 9 including means for randomly selecting a number ranging from one to six and indicating same.

11. Game apparatus according to claim 9 wherein said means for providing indicia of different colors are sets of pegs.

12. Game apparatus according to claim 9 wherein said means for providing five or more radial lines of indicia are at least three ring members mounted on said support base and rotatable thereon about said central location.

13. Game apparatus according to claim 9 wherein said means for providing five or more radial lines of indicia are five ring members mounted on said support base and rotatable thereon about said central location.

* * * * *